US005976631A

United States Patent [19]

Ramachandran

[11] Patent Number: 5,976,631

[45] **Date of Patent: *Nov. 2, 1999**

[54] VISCOUS LIQUID APPLICATOR METHOD

[75] Inventor: Seshadri Ramachandran, Acworth, Ga.

[73] Assignee: E. I. du Pont de Nemours and Company, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/920,920

[22] Filed: Aug. 29, 1997

[51] Int. Cl.[6] ..... B05D 1/02

[52] U.S. Cl. ..... 427/421; 239/526; 239/532

[58] Field of Search ..... 427/421; 239/526, 239/532

[56] References Cited

U.S. PATENT DOCUMENTS

| | | | |
|---|---|---|---|
| 2,981,484 | 4/1961 | Hirsch | 239/530 |
| 4,239,806 | 12/1980 | Hsieh et al. | 428/462 |
| 4,267,782 | 5/1981 | Talbott | 111/7.1 |
| 5,100,060 | 3/1992 | Haferkorn | 239/337 |
| 5,236,499 | 8/1993 | Chervenak et al. | 106/612 |
| 5,250,145 | 10/1993 | Despins et al. | 156/578 |
| 5,366,309 | 11/1994 | Springall | 401/48 |
| 5,462,764 | 10/1995 | Jones et al. | 427/196 |
| 5,479,755 | 1/1996 | Pacione | 52/746.1 |
| 5,536,531 | 7/1996 | Owen et al. | 427/256 |
| 5,671,889 | 9/1997 | Petty | 239/418 |

FOREIGN PATENT DOCUMENTS

| | | | |
|---|---|---|---|
| 2081746 | 4/1994 | Canada | B05C 11/04 |
| 471863 | 2/1992 | European Pat. Off. | B05C 5/00 |
| 549059 | 6/1993 | European Pat. Off. | B05C 11/10 |
| 2702972 | 2/1995 | France | B05C 1/14 |
| 2647815 | 4/1978 | Germany . | |
| 3035520 | 4/1981 | Germany | E04F 21/20 |
| 675890 | 12/1978 | Switzerland | E04F 21/24 |
| 2130283 | 5/1984 | United Kingdom | B05C 17/10 |
| WO 93/05254 | 3/1993 | WIPO | E04F 21/22 |

OTHER PUBLICATIONS

Roberts, Floor Covering Installation Products catalogue, 1994–1995 Edition, cover, pp. 18 and 19.

Graco, Airless Accessories and Replacement Parts catalogue, undated, selected pages (5 sheets).

Graco, Great Tips from Graco brochure, 1992.

*Primary Examiner*—Shrive Beck

*Assistant Examiner*—Michael Barr

[57] ABSTRACT

A method for applying to a surface a viscous liquid having a low shear rate viscosity in the range from about 0.1 Pascal.seconds to about ten (10) Pascal.seconds at a shear rate of ten (10) per second, a shear-thinning power law index in the range from about 0.2 to about 0.6, a high shear rate viscosity in the range from about 0.05 Pascal.seconds to about 0.5 Pascal.seconds at a shear rate of twenty thousand (20,000) per second, and a surface tension in the range from about fifteen (15) dynes/cm. to about sixty (60) dynes/cm. is characterized by pressurizing the liquid to a static pressure in the range from about five hundred (500) pounds per square inch to about fourteen hundred (1400) pounds per square inch, and thereafter spraying the viscous liquid at a dynamic pressure in the range from about one hundred (100) pounds per square inch to about one thousand (1000) pounds per square inch, whereby the liquid emanates as a spray with substantially no mist through a spray tip of an applicator wand. The tip has an orifice size in the range from about 0.025 to about 0.065 inch.

2 Claims, 1 Drawing Sheet

VISCOUS LIQUID APPLICATOR METHOD

BACKGROUND OF THE INVENTION

1. Field of the Invention

The present invention relates to a method for the application of a viscous liquid, such as an adhesive or sealant, to floor and wall surfaces.

2. Description of the Prior Art

When installing carpet it is the usual practice to utilize an adhesive to attach the carpet to the surface of the floor or the wall. Hand troweling is the predominant method for applying adhesives to such surfaces. However, troweling is labor intensive, slow and ergonomically undesirable, and for these reasons is seen as economically disadvantageous.

Included in the prior art is a system for spray application of a liquid adhesive to floor and wall surfaces known as the Roberts Monobond® Spray Adhesive System. FIG. 1 is a highly stylized diagrammatic illustration of the Roberts Monobond® Spray Adhesive System. Such a system includes a high pressure pump P that pumps an adhesive V from a reservoir R, through a flexible hose F, and from a spray wand apparatus generally indicated by character W. Typically the adhesive is a solvent-based adhesive. The pressure of the adhesive is controlled by a pump pressure governor diagrammatically indicated by the reference character G. The spray wand W includes a trigger handle H connected through an extension barrel B to a spray tip T. A system such as that shown in FIG. 1 is believed to have associated with it a number of disadvantages.

Adhesive applied by the known spray system has a tendency to splash, making precision lay-down difficult. By "splashing" it is meant the undesired application of liquid to any nearby surface other than the intended surface, including adjacent wall or floor surfaces, clothing and feet of the operator, etc. Splashing is caused by the rebounding of larger sized droplets upon impact with the surface and is especially disadvantageous in regions of a floor close to a wall surface or adjacent to an existing carpeted area.

Also, the known system generates a high degree of mist. Misting is believed to be disadvantageous for a variety of reasons. Misting causes overspray which is a fringe-like deposition of liquid in a region immediately surrounding the area of desired application. The inhalation of mist is harmful to an operator and requires the use of respirator equipment. Misting often results in an adhesive coating on walls, furnishings and clothing, thus necessitating protective covers. Solvent-based adhesive, the most common adhesive used, emits volatile organic compounds. Thus, it is often necessary to vacate the area of the building during adhesive lay-down. Clean-up of solvent-based adhesive is also difficult, requiring the pumping of large volumes of solvent through the spray system in order to flush the adhesive from the equipment.

The known spray system is believed to have ergonomic problems as well. The system is usually configured so that in order to effect perpendicular-to-the-floor spraying (to minimize splashing) the operator is required to flex the wrist of the arm holding the handle at an uncomfortable angle. Moreover, in order to bring the tip within a reasonably close distance from the surface the operator is required to stoop at the waist. These postures are ergonomically stressful to the operator. The known system also has the disadvantage in use that it frequently results in spraying the tops of the feet of the operator.

In view of the foregoing, it is believed advantageous to provide a method and system for the application of a viscous liquids such as an adhesive or sealant to a surface which overcome the above disadvantages.

SUMMARY OF THE INVENTION

The present invention is directed to a method for the spray application of a shear-thinning viscous liquid, such as a water-based adhesive or a sealant, to a surface.

In accordance with the method of the present invention a viscous liquid having a low shear rate viscosity in the range from about 0.1 Pascal.seconds to about ten (10) Pascal.seconds at a shear rate of ten (10) per second, a shear-thinning power law index in the range from about 0.2 to about 0.6, a high shear rate viscosity in the range from about 0.05 Pascal.seconds to about 0.5 Pascal.seconds at a shear rate of twenty thousand (20,000) per second, and a surface tension in the range from about fifteen (15) dynes/cm. to about sixty (60) dynes/cm., is pressurized to a static pressure in the range from about five hundred (500) pounds per square inch to about fourteen hundred (1400) pounds per square inch, and, more preferably, in the range from about eight hundred (800) pounds per square inch to about fourteen hundred (1400) pounds per square inch. The liquid is thereafter sprayed at a dynamic pressure in the range from about one hundred (100) pounds per square inch to about one thousand (1000) pounds per square inch, and, more preferably, in the range from about four hundred (400) pounds per square inch to about one thousand (1000) pounds per square inch, to cause the liquid to emanate as a spray through the tip of an applicator wand, whereby substantially no misting occurs upon emanation of the liquid from the tip. The spray tip has a diameter in the range from about 0.025 inch to about 0.065 inch. As the operator walks across the floor surface a coating of liquid is applied thereto.

BRIEF DESCRIPTION OF THE DRAWING

The invention will be more fully understood from the following detailed description, taken in connection with the accompanying drawings, in which.

DETAILED DESCRIPTION OF THE INVENTION

Figure 2:
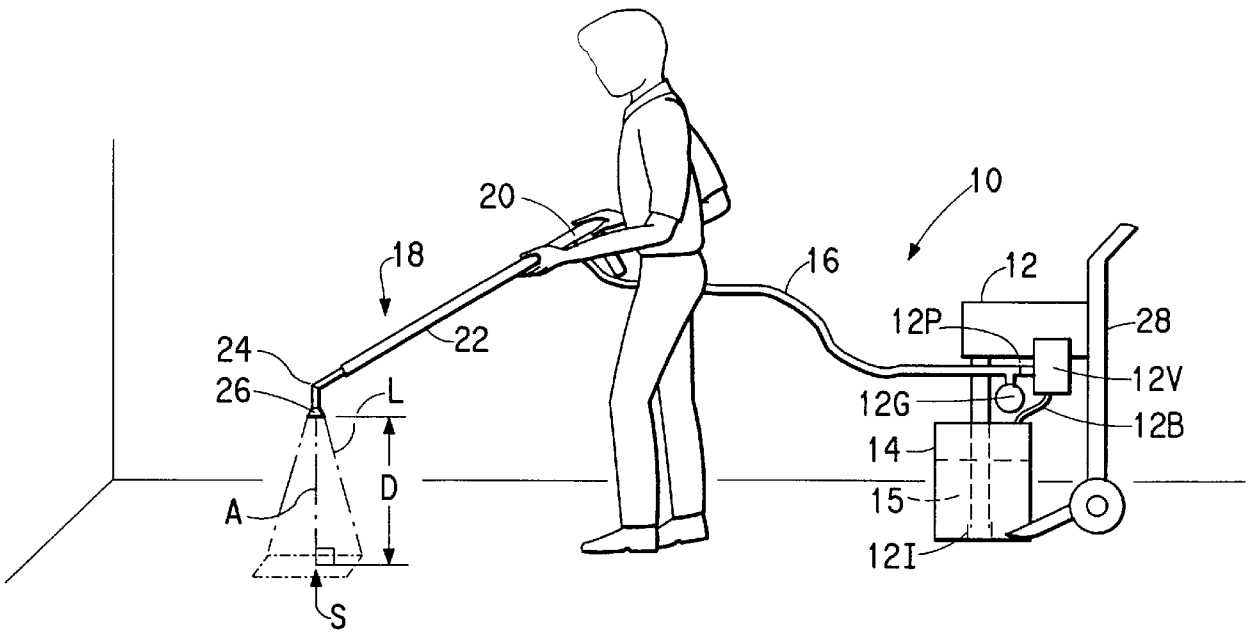
Figure 1:
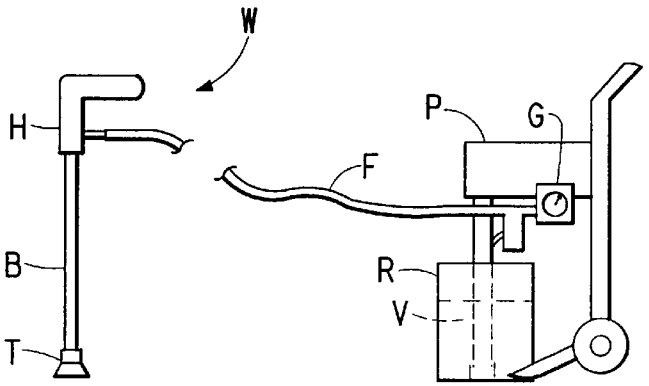
FIG. 1 (PRIOR ART)
FIG. 1 is a highly stylized diagrammatic illustration of a spray apparatus of the prior art; and, FIG. 2 is a highly stylized diagrammatic illustration generally similar to FIG. 1 showing a spray apparatus able to be used to practice the method of the present invention.

FIG. 2 is a highly stylized diagrammatic illustration showing a spray system generally indicated by reference character 10 that includes an apparatus 18 useful for spray application of a viscous liquid to floor and wall surfaces in accordance with the method of the present invention.

The system 10 includes a pump 12 the inlet end 12I of which is immersed into a liquid reservoir 14 containing a viscous liquid 15. The pump 12 includes a selector valve 12V. Depending upon the setting of the selector valve 12V viscous liquid may be recirculated into the reservoir 14 through a bleed line 12B or output from the pump 12 through the pump outlet port 12P. The outlet port 12P of the pump 12 is connected through a hose 16 to a spray apparatus, or wand, generally indicated by the reference character 18. A pressure gauge 12G is incorporated in the line at the outlet port 12P to indicated the pressure at this point. The pressure gauge 12G helps set the static pressure precisely and thus control the spray misting as well as the volume of liquid applied. In the preferred practice of the present invention, other than the coarse twelve-mesh strainer at the inlet 12I of the pump, no other filters are included within the pump 12 in order to prevent shear agglomeration. Also, the large outlet filter housing any other "dead volume" in the system is eliminated. Elimination of dead volume facilitates flushing and cleaning and prevents clogging of the system.

The spray wand 18 includes a trigger handle 20 that is connected through an elongated tubular barrel 22 and an angled adapter 24 to a spray tip 26. In FIG. 2 the barrel 22 is shown as being directly connected to the handle 20 while the adapter 24 is connected to the tip 26. It should be understood, however, that this order of parts may be reversed such that the adapter 24 is connected to the handle 20 while the barrel 22 is connected to the tip 26. Either configuration is seen to provide the advantages listed herein.

The viscous liquid reservoir 14 is preferably implemented using the container in which the viscous liquid is typically sold. The system 10 may be used with any viscous liquid 15 having a relatively high viscosity, the preferred use of the system 10 being the application of a high viscosity water-based sprayable adhesive or sealant to floor and wall surfaces in anticipation of installation of carpet. By "high viscosity" it is meant a liquid that has a low shear rate viscosity in the range from about 0.1 Pascal.seconds to about ten (10) Pascal.seconds at a shear rate of ten (10) per second, a shear-thinning power law index in the range from about 0.2 to about 0.6, and a high shear rate viscosity in the range from about 0.05 Pascal.seconds to about 0.5 Pascal.seconds at a shear rate of twenty thousand (20,000) per second, and a surface tension in the range from about fifteen (15) dynes per centimeter (dynes/cm.) to about sixty (60) dynes/cm. The power law index is the slope of shear stress versus shear rate in a log-log plot. That is, shear stress is proportional to (shear rate) raised to the power n, where n is the power law index. A suitable adhesive is available from Advanced AirTech Adhesives Inc., Dalton, Ga., as product AAT 677. It may be found to be convenient in practice to use the spray system 10 to apply a high viscosity sealant.

In the preferred case the tubular barrel 22 is between one and one-half (1.5) and four (4) feet in length, and more preferably, between two and one-half (2.5) and three and one-half (3.5) feet in length. Suitable for use as the tubular barrel 22 is the three (3) foot extension manufactured by Graco Inc., Minneapolis, Minn., as part number 224-415. The angled adapter 24 is preferably implemented using a forty-five (45) degree fixed angle adapter manufactured by Graco Inc. as part number 224-399.

To practice the method of the present invention the tip 26 may be implemented using any spray tip having an orifice size in the range from about 0.025 inch to about 0.065 inch. Suitable for use is the spray tip having a 0.035 orifice size known as "Reverse-A-Clean Tip" available from Graco Inc. as part number 221-635.

In a embodiment of the apparatus shown in FIG. 2 the tip 26 is implemented using a sharp-edged spray tip. By "sharp-edged" tip it is meant a tip of the kind that permits control of the lay-down location of the liquid adhesive or sealant so that a coating having a sharp, well-defined edge at the applied coating boundary is defined. Suitable sharp-edged spray tips are available from Graco Inc. as part numbers LLT327, LLT625, LLT355.

The pump 12 is conveniently mounted on a wheeled carrier 28. In accordance with the method of the present invention the pump 12 is used to pressurize the high viscosity (as defined above) liquid 15 to a predetermined static pressure in the range from about five hundred (500) pounds per square inch to about fourteen hundred (1400) pounds per square inch, and, more preferably, in the range from about eight hundred (800) pounds per square inch to about fourteen hundred (1400) pounds per square inch and to a predetermined dynamic pressure dynamic pressure in the range from about one hundred (100) pounds per square inch to about one thousand (1000) pounds per square inch, and, more preferably, in the range from about four hundred (400) pounds per square inch to about one thousand (1000) pounds per square inch.

A pump suitable for use within the system 10 must be capable of maintaining substantially constant liquid pressure throughout the entire dynamic pressure range. For better uniformity of coating the higher pressure values in the defined ranges (consistent with the minimization of misting) should be used. Suitable for use as the pump 12 having a such control is the pump manufactured by Graco Inc. and sold as model "Ultra-Plus 600", part number 231-358. This pump model includes a one-quarter (0.25) inch hose (Graco Inc. part number 223-541) and a handle useful as the handle 20. A three sixteenth inch by three foot whip hose is attached between the hose and the handle to provide flexibility.

In accordance with the method of the present invention the common problem of misting of liquid as it emanates from the spray tip 26 is substantially eliminated by the use of high viscosity liquids pressurized to a static pressure and a dynamic pressure in the ranges described above. Further, the use of the sharp-edged spray tip in the particular embodiment of the apparatus of the invention permits an even coating of viscous liquid with crisp edges to be achieved.

The spray gun handle 20, the tubular barrel 22 and the adapter 24 are arranged with respect to each other such that when the handle 20 of the wand 18 is comfortably held by an operator who is standing in a substantially upright position the axis A of the liquid spray L emanates from the tip 26 at approximately ninety (90) degrees to the floor surface. If spraying is attempted with the spray axis A at other than approximately ninety (90) degrees to the surface, splashing may result.

The handle 20, the barrel 22, the angled adapter 24 are sized to define an ergonomic spray wand 18 whereby the spray tip 26 may be positioned by the operator within a predetermined optimum distance from the surface F without the need for stooping as is typically necessary in prior spray systems. In the ergonomic spray system 10 of the present invention, when the handle 20 is held by the operator standing in the substantially upright position as illustrated in FIG. 2, the tip 26 is preferably within a predetermined distance D from the floor surface. The distance D is within two (2) feet, and more preferably, about one (1) foot from the floor surface. By keeping the tip 26 within these predetermined optimum distances the operator is more easily able to control the angle at which the axis A is oriented with respect to the floor surface. Keeping the tip 26 within these distances from the floor surface also minimizes the likelihood of any splashing or misting. Holding the wand 18 with one hand on the handle 20 and the other on the barrel 22, as is illustrated, prevents the operator from "waving" the spray wand (by rotating the wrist) and moving the spray axis from its perpendicular orientation. Instead, use of a more convenient side-to-side "swinging" motion (by rotation of the torso at the waist) permits sweeping coverage with the axis held at the desired perpendicular orientation.

The method of use of the system of the present invention in applying viscous liquid 15 to a floor surface in anticipation of installation of carpet may be understood from the following discussion. Prior to use the optimum apparatus elements are chosen consistent with the ergonomic considerations, discussed above, and the size and productivity parameters of the specific application at hand. The reservoir 14 of high viscosity liquid (as defined above) is placed in the carrier 28 so that it may be conveniently maintained within a close proximity (within the hose length) of the area being coated.

With the selector valve 12V in the active position the pump pressure is adjusted from its lowest pressure setting to a desired static pressure lying within the predetermined static pressure range. Since the trigger on the handle is not yet asserted, no liquid flow occurs. Hence, the pressure value indicated on the gauge 12G is the static pressure reading. Thereafter, the trigger of the handle 20 is asserted and viscous liquid at a dynamic pressure lying within the predetermined dynamic pressure range is pumped by the pump 12, through the hose 16, to the wand 18. The liquid emanates as a spray through the tip 26 of the wand 18. The actual pressure values for the static and dynamic pressures are determined empirically, with the pressure set sufficiently high so that the flow of the liquid is steady, while at the same time low enough so that substantially no misting (and thus, no overspray) occurs.

The operator applies the liquid 15 to the floor surface while holding the spray gun handle 20 in an ergonomic position. An ergonomic position may be defined as one in which the physical stresses and fatigue on the operator are minimized, and the operator may work comfortably for a relatively long period of time. For instance, the operator's wrist should be held relatively straight while holding the spray gun handle 20, while the shoulders are relaxed and the elbow is kept in a natural position. The operator should be standing upright so as to minimize any stress to the lower back.

When the wand is so held as described above, the tip 26 lies within two (2) feet, and more preferably, about one (1) foot, of the floor surface, and the axis A of the viscous liquid spray emanating from the spray tip 26 is approximately ninety (90) degrees to the floor surface, so that substantially no splashing occurs. As the operator walks across the floor surface the liquid coating is applied in a substantially rectangular pattern S to the area to be coated. The dimensions of the pattern S are dependent upon the distance D and the spray tip used. The posture of the operator, and the orientation of the wand 18 is adjusted appropriately if it is desired to apply a coating to the portion of the wall surface adjacent to the floor.

The crisp edges of the liquid as applied by using the system of the present invention reduce the amount of overlap required between successive passes of liquid with the spray tip 26. The even application of the liquid provided by the use of the invention reduces the need for manual fill-in of unsprayed areas. These advantages are believed to provide increases in productivity as compared with existing systems.

Because both misting and splashing are substantially eliminated the problem of sticky walls and furnishings is avoided. The need to cover wall and floor surfaces adjacent to the area to be coated to protect them from splashing and misting is rendered unnecessary when the method of the invention is to be used. The elimination of this step provides an increase in productivity as compared with the use of existing systems.

The use of the preferred, water-based adhesives as the viscous liquid avoids the problems associated with solvent-based systems, such as volatile organic compounds, are eliminated. As discussed herein, practicing the method of the present invention reduces misting and overspray, and thus avoids coating adhesive on walls, furnishing and clothing. For another thing, water-based adhesives allow much easier clean-up of spray equipment following use. In solvent-based systems, expensive and hazardous solvents must be pumped through the equipment to remove the adhesive after use. In the water-based system according to the invention, the equipment is cleaned by flushing water through the system after use to eliminate residual viscous liquid. This may be followed by flushing with mineral thinner which may prevent rusting of pump and spray system components.

In view of the ergonomic advantages provided by the particular embodiment of the apparatus herein described, its use is preferred. However, it should be understood that the method of the present invention may be implemented using any spray apparatus, including a spray apparatus configured as described in the prior art.

Those skilled in the art, having the benefit of the teachings of the present invention as set forth herein, may effect numerous modifications thereto. Such modifications are to be construed as lying within the contemplation of the present invention, as defined by the appended claims.

What is claimed is:

1. A method for applying a shear-thinning viscous liquid to a surface, the method comprising the steps of:

(a) pressurizing a viscous liquid having a low shear rate viscosity in the range from about 0.1 Pascal.seconds to about ten (10) Pascal.seconds at a shear rate of ten (10) per second, a shear-thinning power law index in the range from about 0.2 to about 0.6, a high shear rate viscosity in the range from about 0.05 Pascal.seconds to about 0.5 Pascal.seconds at a shear rate of twenty thousand (20,000) per second, and a surface tension in the range from about fifteen (15) dynes/cm. to about sixty (60) dynes/cm.

to a static pressure in the range from about five hundred (500) pounds per square inch to about fourteen hundred (1400) pounds per square inch, (b) spraying the viscous liquid at a dynamic pressure in the range from about one hundred (100) pounds per square inch to about one thousand (1000) pounds per square inch to cause the liquid to emanate as a spray through a spray tip of an applicator wand tip having an orifice size in the range from about 0.025 to about 0.065 inch, whereby substantially no misting occurs upon emanation of the liquid from the tip, and (c) moving the wand with respect to the surface to apply a coating of liquid thereto.

2. The method of claim 1 wherein the static pressure in the range from about eight hundred (800) pounds per square inch to about fourteen hundred (1400) pounds per square inch and wherein the dynamic pressure is in the range from about four hundred (400) pounds per square inch to about one thousand (1000) pounds per square inch.

* * * * *